US006783145B2

(12) United States Patent
Deborde et al.

(10) Patent No.: US 6,783,145 B2
(45) Date of Patent: Aug. 31, 2004

(54) RAISING PLATFORM FOR A BINDING OF A BOARD FOR GLIDING, AND BOARD FOR GLIDING EQUIPPED WITH SUCH A PLATFORM

(75) Inventors: Henri-Charles Deborde, Bilieu (FR); Alain Zanco, La Buisse (FR); Milena Stefanova, Saint Barthelemy de Sechilienne (FR); Jacques Fagot, Saint Jean de Moirans (FR); Michel Echevin, Meylan (FR)

(73) Assignee: Skis Rossignol S.A., Voiron (FR)

( * ) Notice: Subject to any disclaimer, the term of this patent is extended or adjusted under 35 U.S.C. 154(b) by 119 days.

(21) Appl. No.: 10/078,911

(22) Filed: Feb. 20, 2002

(65) Prior Publication Data

US 2002/0113411 A1 Aug. 22, 2002

(30) Foreign Application Priority Data

Feb. 20, 2001 (FR) ..... 01 02280

(51) Int. Cl.[7] ..... A63C 5/00

(52) U.S. Cl. ..... 280/607; 280/617; 280/610; 280/624

(58) Field of Search ..... 280/607, 617, 280/608, 610, 611, 616, 601, 618, 602, 636, 623, 624, 633, 635, 609

(56) References Cited

U.S. PATENT DOCUMENTS

| | | | | | |
|---|---|---|---|---|---|
| 4,300,786 | A | | 11/1981 | Alley | 280/602 |
| 4,725,070 | A | | 2/1988 | Maruyama | 280/610 |
| 5,232,241 | A | | 8/1993 | Knott | 280/607 |
| 5,280,943 | A | | 1/1994 | Commier et al. | 280/609 |
| 5,333,889 | A | * | 8/1994 | Piegay et al. | 280/602 |
| 5,366,234 | A | | 11/1994 | Rohrmoser | 280/610 |
| 5,393,086 | A | * | 2/1995 | Le Masson et al. | 280/602 |
| 5,397,150 | A | * | 3/1995 | Commier et al. | 280/607 |
| 5,427,401 | A | | 6/1995 | Liard | 280/609 |
| 5,470,094 | A | | 11/1995 | Commier et al. | 280/602 |
| 5,553,884 | A | | 9/1996 | Abondance | 280/609 |
| 5,871,223 | A | * | 2/1999 | Zanco | 280/607 |
| 5,944,336 | A | * | 8/1999 | Fagot | 280/607 |
| RE36,586 | E | | 2/2000 | Abondance et al. | 280/602 |
| 6,158,747 | A | | 12/2000 | Magnani | 280/11.14 |
| 6,193,262 | B1 | * | 2/2001 | Silva | 280/607 |
| 6,217,055 | B1 | * | 4/2001 | Silva | 280/607 |
| 6,227,558 | B1 | * | 5/2001 | Arduin et al. | 280/611 |
| 6,237,932 | B1 | | 5/2001 | Zanco et al. | 280/602 |
| 6,257,612 | B1 | * | 7/2001 | Zanco et al. | 280/607 |

(List continued on next page.)

FOREIGN PATENT DOCUMENTS

| | | | | |
|---|---|---|---|---|
| DE | 682623 | | 9/1939 | |
| DE | 3937617 | | 7/1990 | |
| EP | 490044 | | 6/1992 | |
| EP | 0620028 | | 10/1994 | |
| FR | 2698012 | | 5/1994 | |
| FR | 2775437 | | 9/1999 | |
| FR | 2 775 437 | | 9/1999 | |
| FR | 2 781 166 | | 1/2000 | |
| FR | 2 786 403 | | 6/2000 | |
| JP | 253328 | | 5/1993 | |
| JP | 5-277220 | * | 5/1993 | A63C/5/12 |
| WO | WO 99/38583 | | 8/1999 | |

*Primary Examiner*—Brian L. Johnson
*Assistant Examiner*—J. Allen Shriver
(74) *Attorney, Agent, or Firm*—Heslin Rothenberg Farley & Mesiti P.C.; Victor A. Cardona

(57) ABSTRACT

A raising platform for a binding for a board for gliding over snow, including a planar central zone capable of receiving the front stop and the heel piece of the binding, and two lateral portions of which the lower edge is intended for interacting with the board for gliding, wherein the lower edge of the lateral portions has, in a longitudinal plane, a certain gradient relative to the plane of the central zone.

16 Claims, 3 Drawing Sheets

U.S. PATENT DOCUMENTS 6,412,807 B1 * 7/2002 Arduin et al. ..... 280/607
6,481,741 B1 11/2002 Porte ..... 280/609
2001/0010420 A1 * 8/2001 Arduin et al. ..... 280/611
2001/0022439 A1 9/2001 Andrus et al. ..... 280/610
2001/0035630 A1 11/2001 Cuzzit et al. ..... 280/609
2002/0014757 A1 * 2/2002 Silva ..... 280/607
2002/0047250 A1 * 4/2002 Luitz et al. ..... 280/607
2002/0117832 A1 * 8/2002 Gatel ..... 280/617
2003/0025299 A1 * 2/2003 Noviant ..... 280/607
2003/0085550 A1 * 5/2003 Godde et al. ..... 280/617
2004/0017062 A1 * 1/2004 Cuzzit et al. ..... 280/607

* cited by examiner

RAISING PLATFORM FOR A BINDING OF A BOARD FOR GLIDING, AND BOARD FOR GLIDING EQUIPPED WITH SUCH A PLATFORM

CROSS REFERENCE TO RELATED APPLICATIONS

This application claims the priority of French application FR/01.02280, filed Feb. 20, 2001, the entire disclosure of which is incorporated herein by reference.

1. Technical Field

The invention relates to the field of sports involving gliding over snow and, more particularly, downhill skiing. It relates more specifically to downhill skis equipped with a platform for raising the binding. It relates more particularly to a novel configuration of the zone of contact between the actual ski and the raising platform.

2. Prior Art

Downhill skis are generally equipped with a safety binding composed of a front stop and a heel piece. It has already been proposed to fit the two elements of the binding not directly onto the board for gliding, but onto a raising platform which is itself secured to the board. This raising platform makes it possible to ensure unclamping of the binding relative to the ski, i.e. to limit the influence of the stiffness of the boot sole on that of the board for gliding.

Various architectures for the raising platform have already been proposed and, in particular, that described in document EP 0 744 196, which corresponds to document U.S. Pat. No. 5,944,336.

One of the platforms described in that document has a planar central zone capable of receiving the front stop and the heel piece of the binding. This planar central zone extends laterally via two lateral portions, the lower edge of which interacts with the board for gliding. To this end, the board for gliding has, in its lateral zones, recesses inside which the lateral portions of the platform are placed. More precisely, in these lateral zones, the board for gliding has thinner zones. The raising platform thus straddles the central part of the board for gliding, resting both on the central part of the board for gliding and on the base of the recesses made in the lateral zones of the board.

A further example of a raising platform was described in document FR 2 781 166. The board for gliding described in that document has, in its lateral zones, recesses on which the lateral portions of the platform can rest. These recesses are produced above a reinforcement element which forms the side of the ski. This reinforcement element is located in line with the bead of the metal edges, and in particular makes it possible to transmit bearing forces efficiently toward said edges.

Owing to the geometry of the lateral zones of the platforms described in these documents, the bases of the recesses made in the board are totally parallel to the gliding sole plate.

The presence of the recesses on the lateral faces of the board affects the stiffness of the board and the way in which the forces are transmitted from the user's foot toward the edges.

One of the aims of the invention is to improve the ski's behavior by modifying the influence of these recesses.

SUMMARY OF THE INVENTION

The invention relates firstly to a raising platform for a binding for boards for gliding. In a known manner, such a platform includes a planar central zone capable of receiving the front stop and the heel piece of the binding, and two lateral portions of which the lower edge is intended for interacting with the board for gliding or for facing portions thereof.

According to the invention, this platform is noteworthy in that the lower edge of the lateral portions has, in a longitudinal plane, a non-zero gradient relative to the plane of the central zone.

In other words, the platform comes into contact with or faces the board for gliding or, more generally, interacts with the latter via zones which are not parallel to the gliding sole plate or to the topsheet of the ski, but which has a gradient.

In this way, by being displaced in a longitudinal direction, the point of contact between the platform and the board for gliding is located at a height which can vary relative to the gliding sole plate. The lateral portions of the platform, when they come into contact with the board for gliding, thus exert a force on a point of contact which is located at a distance which can vary relative to the plane receiving the front stop and the binding. This arrangement is advantageous and makes the ski behave better particularly during the transition between the phases of initiating a turn and executing the turn.

Advantageously, in practice, the lateral portions of the platform extend from either side of the boot center position.

The invention also relates to a board for gliding equipped with such a platform. In a known manner, this board includes:

- a lower gliding surface composed of a gliding sole plate bordered by metal edges;
- a topsheet;
- lateral zones, extending on either side of the topsheet, receiving the contact of the lower edges of the lateral portions of the platform;

According to the invention, this board is noteworthy in that the lateral zones have recesses, the lower part of which includes a slope which is inclined longitudinally relative to the gliding surface of the board.

Moreover, the lower edges of the lateral portions of the platform include a complementary slope which is inclined longitudinally relative to the gliding surface of the board.

In other words, the platform according to the invention is placed on the board for gliding with its lateral portions which are inserted in complementary recesses or housings located on the board. The gradient of the lower edges of the lateral portions of the platform is identical to the gradient of the base of the recess of the board relative to the gliding surface, such that the zone in which the platform and the recesses of the board face one another extends over a great part of the recess.

The variable thickness of the board for gliding in the region of the recesses gives the board properties which improve the distribution of the forces exerted by the skier, particularly in the phases of initiating a turn and executing the turn.

This arrangement may be employed for numerous board architectures, irrespective of their internal structure and of the fact that these may be skis "with sides" or skis "with a shell".

Thus, in the case of a ski with sides, the board has lateral reinforcement elements located in line with at least one part of the bead of the metal edges. In this case, the recesses of the lateral zones form hollowed zones which are connected to said lateral reinforcement elements. In other words, the recesses of the lateral zones of the board form hollowed zones inside the lateral reinforcement elements. In these hollowed zones, the thickness of the lateral reinforcement element is less than that which it has in the rest of the ski, and it can also vary, thus forming the characteristic slope.

In a particular embodiment, the base of the recesses may have an orientation inclined toward the front and toward the bottom of the board. In other words, the thickness of the ski is less in front of the recesses than to the rear of the latter. Of course, the other orientation may also offer certain advantages. In this case, the base of the recesses has a gradient oriented toward the rear and toward the bottom of the ski.

In this latter case, the gradient of the zone of interaction between the platform and the board, particularly when it is produced actually inside the reinforcement element, moves the bearing pressure toward the front of the ski during turning and thus improves the actual execution of the turn. In other words, when the characteristic recesses are shallower on the front side of the board, the latter is relatively stiffer in the front part of the underfoot zone than in the rear part of this same underfoot zone. In the event of use of a reinforcement element, the lower height of the lateral reinforcement element is located more in the rear part of the underfoot zone. This phenomenon concentrates maximum power during edging and thus maximum gripping of the ski under the foot during initiation of a turn.

In a particular embodiment, the board for gliding may include, to the front and to the rear of the lateral portions of the platform, an additional element interposed between the lower face of the platform and the topsheet of the board. This additional element is intended for modifying the dynamic behavior of the board. This additional element may be produced either from a viscoelastic material, when it is desired to obtain certain damping properties, or may also be produced from an elastic material when it is desired to make the board more dynamic and to ensure a more rapid return to position after a bending of the board opposed by the platform.

In certain variant embodiments, the board for gliding may include a number of recesses made on the same side of the board. These recesses, numbering two or three, may have gradients oriented in the same direction or, in a preferred embodiment, in opposite directions. The platform then includes lateral portions of which the lower edges have complementary gradients.

Thus, in a particular embodiment, the board has two recesses on each side. The recess located to the front has a gradient oriented toward the bottom and toward the front. The recess located to the rear has a gradient oriented toward the top and toward the front (or, in an equivalent manner, toward the bottom and toward the rear).

DESCRIPTION OF THE DRAWINGS

The way in which the invention is embodied and also the advantages arriving therefrom will become clearly apparent from the description of the following embodiments, supporting the appended figures, in which.

IMPLEMENTATION OF THE INVENTION

As already stated, the invention relates to a board for skiing equipped with such a platform in which the zone of contact or of interaction between the board and the platform has a particular geometry.

Figure 1:
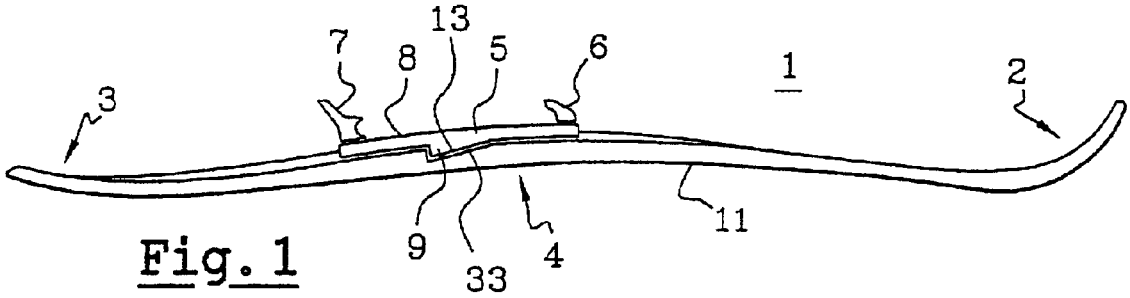
FIG. 1 is a general side view of a ski according to the invention.

More precisely, and as illustrated in FIG. 1, the ski (1) according to the invention comprises a toe zone (2) and a heel zone (3) located on either side of the underfoot zone (4). In the underfoot zone (4), the ski is equipped with a raising platform (5) intended for receiving the front stop (6) and the heel piece (7) of the binding.

The front stop (6) and the heel piece (7) of the binding are fixed onto a part of the raising platform which forms a flat zone (8) extending over at least the area separating the front stop (6) from the heel piece (7), and even beyond this, optionally bearing on the topsheet of the ski (1). This central zone (8) extends laterally via lateral portions (9) which are substantially perpendicular thereto and which descend toward the lower ridge (11) of the ski.

Figure 3:
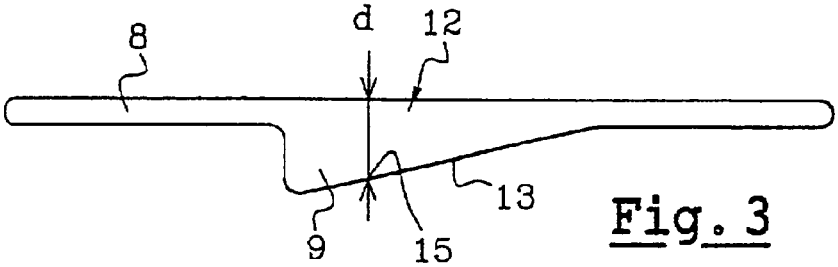
FIG. 3 is a side view of the platform according to the invention, shown alone.

More precisely, and as illustrated in FIG. 3, these lateral portions 9 are located substantially in the region of the boot center (12), i.e. substantially midway along the platform. According to a characteristic of the invention, these lateral portions (9) have a lower edge (13) which is not parallel to the upper plane of the central zone 8 of the platform. More precisely, the lower edge (13) of these lateral portions (9) is slightly inclined by an angle of between 1° and 20°, and preferably between 2° and 5° relative to the central zone (8) of the platform. In other words, the distance d which vertically separates the central zone (8) from the platform and the lowest point (15) of the lateral portions (9) at a given longitudinal point evolves over the length of the lateral portion (9) in question.

As already stated, the invention also relates to a characteristic board for gliding which is configured for receiving the platform described above.

Figure 2:
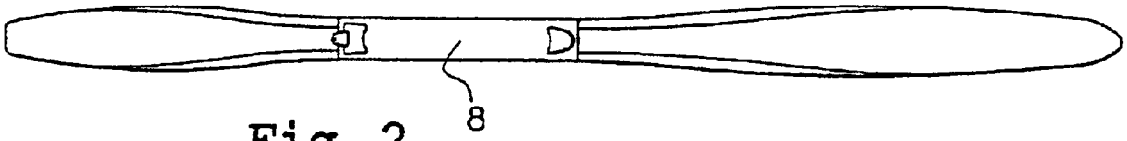
FIG. 2 is a top view of the ski of FIG. 1.

As illustrated in FIGS. 1 and 2, the board for gliding (1) according to the invention includes a lower gliding surface (20) which comprises, principally, a gliding sole plate (21) and metal edges (22). The metal edges (22) themselves consist of two principal portions, namely a bead (23) which forms the lower ridges of the board, and which is intended for coming into contact with the snow, and a generally elongate fin (24) which extends inside the board's structure in order to guarantee anchoring of the edge (22) in the actual structure.

Figure 4:
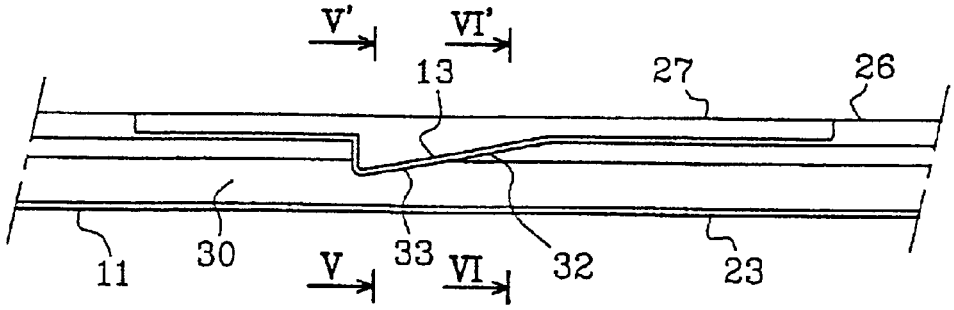
FIG. 4 is a detailed side view of the ski of FIG. 1 in the zone of interaction of the platform and the actual ski.

The board also includes a topsheet (26) which is intended for receiving the contact of the raising platform (5) and which has a substantially planar geometry. Topsheet (26) may also have recesses or other, protuberant zones over its entire length. With reference to figure 4, the topsheet (26) may, in particular, have a housing in which the platform fits, in such a manner that a topsheet (27) of the platform and topsheet (26) of the ski to the front and to the rear of the platform are substantially a continuation of one another.

Between the topsheet (26) of the board and the ridges formed by the edges (22), the board according to the invention includes lateral zones (28) which can match various geometries depending on the internal structure employed for producing the board. Thus, in a first family of skis according to the invention, the lateral zones of the board are equipped with lateral reinforcement elements (30) forming the sides of the ski.

In another embodiment, corresponding to skis with a shell structure, the lateral zones 40 of the board are slightly inclined so that the ski assumes a substantially trapezoidal cross section.

According to the invention, the lateral zones of the board have recesses or hollowed zones (32) intended for receiving the lateral portions (9) of the raising platform. As illustrated in FIG. 2, these recesses create a reduced thickness for the ski in these lateral zones. These recesses may extend beyond the zone where the raising (5) platform (8) is installed, in order to give the board particular mechanical and/or esthetic properties.

In the zone where the raising platform (5) is installed, the recesses (32) have a particular geometry in which their base (33) has a non-zero gradient relative to the gliding sole plate. In this way, the base (33) of the recesses forms a longitudinally inclined slope which has the gradient which complements that of the lower edge (13) of the platform (5).

Figure 5:
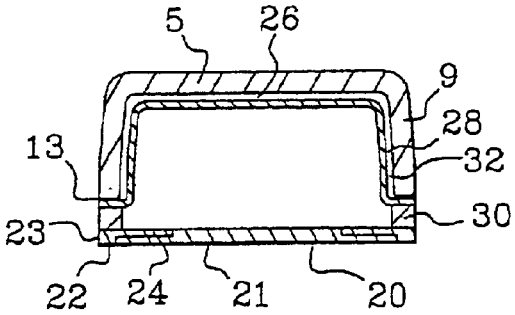
FIGS. 5 and 6 are, respectively, sections in the planes V–V' and VI–VI' of FIG. 4.
Figure 6:
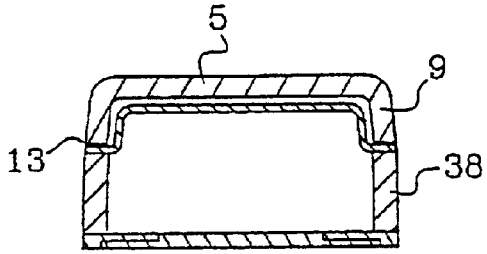

If the side of the ski has a lateral reinforcement element, as illustrated in FIGS. 5 and 6, the characteristic recess results in a localized reduction in the height of this reinforcement element. More precisely, and as illustrated in FIG. 5, in the deepest zone of the recess the lateral reinforcement element (30) has a reduced height. The partial stiffness of the board close to this particular zone is thus relatively reduced.

Conversely, and as illustrated in FIG. 6, in the longitudinally opposite zone of the recess, the lateral reinforcement element (38) has a greater height, so the partial stiffness of the board is locally greater.

The shape of the base of the recess is not limited just to the embodiment illustrated in the figures, but also covers the variant embodiments in which the slope is not constant but progressive over the length of the characteristic recess or, alternatively, in which the orientation of the slope is not toward the top and toward the front, but toward the bottom and toward the front. Moreover, the base of the recess may also have a transverse gradient combined with the characteristic longitudinal gradient.

Figure 7:
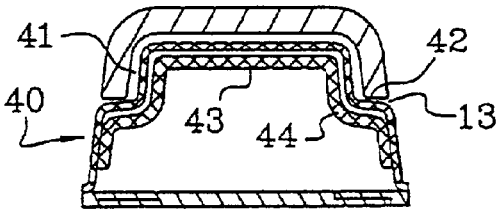
FIG. 7 is a sectional view similar to that of FIG. 4, in a variant embodiment.

Moreover, the characteristic geometry of the recesses receiving the lateral portions of the platform is not limited either to just the internal board structures which include lateral reinforcement elements, but also covers the structures of boards "with a shell", as illustrated in FIG. 7. In this case, the lateral faces (40) of the board include recesses (41) of which the base (42) also has the characteristic gradient. In the region of these recesses, the upper reinforcement (43) has deformed zones (44) corresponding to the reinforcements of the recesses (41).

Generally speaking, the invention is not limited to these particular structures "with sides" or "with shell", but also covers variant embodiments combining these two structures, for example when the bottom part of the board is produced with lateral reinforcement 4 elements while the upper part includes a box or shell structure.

The invention is not limited either to a particular core construction, but may, on the contrary, come in a very large number of structures.

Figure 8:
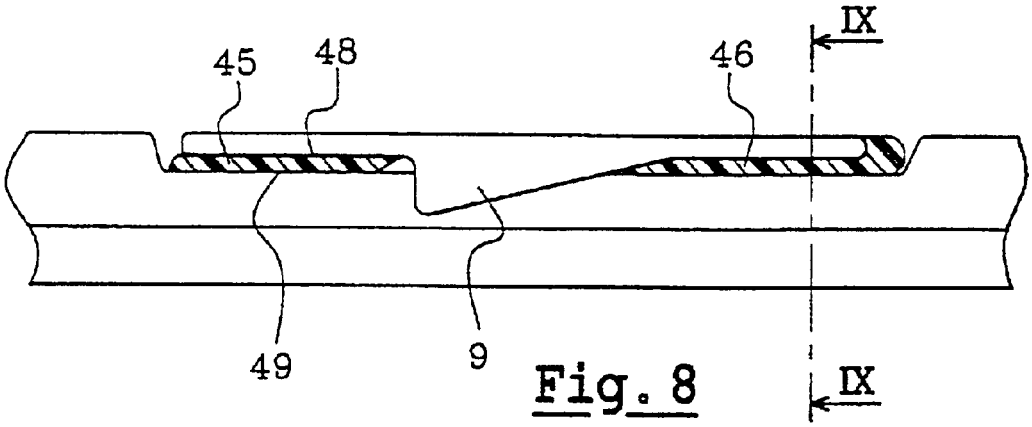
FIG. 8 is a diagrammatic side view of a variant embodiment of the board according to the invention.
Figure 9:
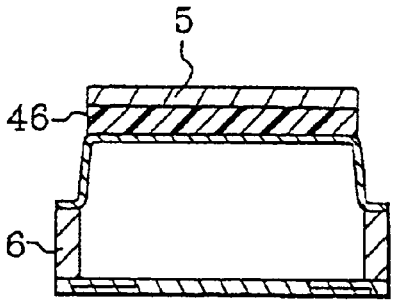
FIG. 9 is a sectional view in the plane IX–IX' of FIG. 8.

In a variant embodiment illustrated in FIGS. 8 and 9, the board also comprises an additional element (45, 46) interposed between the lower face (48) of the platform (5) and the topsheet (49) of the board.

This additional element is arranged to the front and/or to the rear of the lateral portions (9) of the platform, and it is intended for conferring particular mechanical properties as a function of the material used.

This element may extend over the entire width of the board or, alternatively, be limited to the periphery of the platform, as illustrated in FIG. 9, and serve to some extent as a seal between the outside and the underside of the platform.

The arrangement of the additional element may also be chosen so that its effect is maximized or optimized at certain zones of the board.

Different materials may be used to form this additional element. Thus, when the material used is an elastomeric material with viscoelastic properties, its presence will tend to damp the comfort of the board by absorbing some of the forces passing through the zone where it is placed. Some of the vibration propagating in the board may thus be damped.

When the additional element is produced from a solely elastic elastomeric material, it has a spring effect which accelerates the return into position when this additional element is compressed. Thus, when the ski bends through the effect of forces exerted in line with the elastomeric additional element, the disappearance of these forces when the skier changes position gives rise, thanks to the additional element, to the more rapid return of the board toward its initial curvature. This is a dynamizing effect which may be appreciated when it is necessary, for example, to execute rapid, linked turns.

The choice of the materials used, namely either an essentially elastic or viscoelastic material, and their location, either to the front or to the rear, or in both places, make it possible to vary and optimize the behavior of the board associated with the platform, depending on the levels of performance sought.

Figure 10:
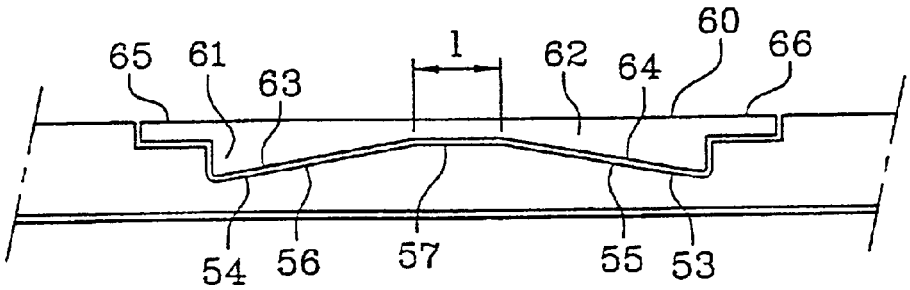
FIG. 10 is a diagrammatic side view of another variant embodiment.

Another variant embodiment is illustrated diagrammatically in FIG. 10. In this case, the board has two recesses (53, 54) produced on each lateral zone of the board. Each of these recesses (53, 54) is of similar design to those described above. In the particular embodiment illustrated, the base (55) of the front recess (53) has a gradient oriented toward the bottom and toward the front. The base (56) of the rear recess (54) has a gradient oriented toward the top and toward the front (or, in an equivalent manner, toward the bottom and toward the rear).

The length (*l*) of the substantially horizontal portion (57) separating the two recesses (53, 54) can vary in accordance with the slopes and lengths of the recesses (53, 54). It may also be reduced to a zero value so that these two recesses are then contiguous.

The platform (60) has, on each side, two lateral portions of which the lower edge (63, 64) is also inclined in the form of a slope which complements that of the recesses (53, 54).

Portions (65, 66) extending the platform further to the front and further to the rear than the lateral portions (61, 62) are illustrated in FIG. 10, but the platform may be omitted without departing from the scope of the invention.

It emerges from the aforesaid that the board for gliding equipped with the characteristic platform offers numerous advantages and, in particular, a distribution of the stiffness in the underfoot zone which makes it possible to concentrate maximum power in the region of the edges and thus maximum gripping of the ski under the foot during the initiation of a turn.

Moreover, if the gradient of the characteristic recess is oriented toward the front and toward the top, moving of the pressure of the bearing points toward the front of the ski during a turn and thus an improvement in the actual execution of the turn are observed.

What is claimed is:

1. A board for gliding equipped with a raising platform for a binding, comprising:

a platform including a planar central zone configured to receive a front stop and a heel piece of the binding, and two lateral portions having lower edges configured to engage a board for gliding, wherein the lower edges of the lateral portions have, in a longitudinal plane, a certain gradient relative to the plane of the central zone;

the board comprising:

a lower gliding surface comprising a gliding sole plate bordered by metal edges;

a topsheet;

lateral zones, extending on either side of the topsheet, said zones configured to receive the lower edges of the lateral portions of the platform;

wherein said lateral zones have recesses, lower parts of the recesses include slopes which are inclined longitudinally relative to the gliding surface of the board, and wherein the lower edges of the lateral portions of the platform include complementary slopes inclined longitudinally relative to the gliding surface of the board and wherein the lower edges continuously contact the topsheet; and wherein the lower part of the recesses has a gradient oriented toward the front and toward the bottom of the board.

2. The board as claimed in claim 1, wherein the lateral portions extend on either side of the boot center position.

3. The board for gliding as claimed in claim 1, which has lateral reinforcement elements located in line with at least one part of the bead of the metal edges, and wherein the recesses of the lateral zones form hollowed zones which are connected to said lateral reinforcement elements.

4. The board for gliding as claimed in claim 1, which, to the front and to the rear of the lateral portions of the platform, includes an additional element interposed between the lower face of the platform and the topsheet of the board.

5. The board for gliding as claimed in claim 4, wherein the additional element is produced from a viscoelastic material.

6. The board for gliding as claimed in claim 4, wherein the additional element is produced from an elastic material.

7. The board for gliding as claimed in claim 1, wherein each lateral zone has two recesses, the lower part of which includes a gradient which is inclined longitudinally relative to the gliding surface.

8. A board for gliding equipped with the raising platform for a binding as claimed in claim 2, including:

a lower gliding surface comprising a gliding sole plate bordered by metal edges;

a topsheet;

lateral zones, extending on either side of the topsheet, said zones adapted to receive the lower edges of the lateral portions of the platform;

wherein said lateral zones have recesses, lower parts of the recesses include slopes which are inclined longitudinally relative to the gliding surface of the board, and wherein the lower edges of the lateral portions of the platform include complementary slopes inclined longitudinally relative to the gliding surface of the board.

9. The board for gliding as claimed in claim 8, which has lateral reinforcement elements located in line with at least one part of the bead of the metal edges, and wherein the recesses of the lateral zones form hollowed zones which are connected to said lateral reinforcement elements.

10. The board for gliding as claimed in claim 8, wherein the lower part of the recesses has a gradient oriented toward the front and toward the bottom of the board.

11. The board for gliding as claimed in claim 8, wherein the lower part of the recesses has a gradient which is oriented toward the rear and toward the bottom of the ski.

12. The board for gliding as claimed in claim 8, which, to the front and to the rear of the lateral portions of the platform, includes an additional element interposed between the lower face of the platform and the topsheet of the board.

13. The board for gliding as claimed in claim 12, wherein the additional element is produced from a viscoelastic material.

14. The board for gliding as claimed in claim 12, wherein the additional element is produced from an elastic material.

15. The board for gliding as claimed in claim 8, wherein each lateral zone has two recesses, the lower part of which includes a gradient which is inclined longitudinally relative to the gliding surface.

16. A board for gliding equipped with a raising platform for a binding, comprising:a platform including a planar central zone configured to receive a front stop and a heel piece of the binding, and two lateral portions having lower edges configured to engage a board for gliding, wherein the lower edges of the lateral portions have, in a longitudinal plane, a certain gradient relative to the plane of the central zone;

the board comprising:

a lower gliding surface comprising a gliding sole plate bordered by metal edges;

a topsheet;

lateral zones, extending on either side of the topsheet, said zones configured to receive the lower edges of the lateral portions of the platform;

wherein said lateral zones have recesses, lower parts of the recesses include slopes which are inclined longitudinally relative to the gliding surface of the board, and wherein the lower edges of the lateral portions of the platform include complementary slopes inclined longitudinally relative to the gliding surface of the board and wherein the lower edges continuously contact the topsheet; and wherein the lower part of the recesses has a gradient which is oriented toward the rear and toward the bottom of the ski.

* * * * *

UNITED STATES PATENT AND TRADEMARK OFFICE

CERTIFICATE OF CORRECTION

PATENT NO. : 6,783,145 B2
DATED : August 31, 2004
INVENTOR(S) : Deborde et al.

It is certified that error appears in the above-identified patent and that said Letters Patent is hereby corrected as shown below:

Title page,
Item [75], Inventors, delete "Milena Stefanova, Saint Barthelemy de Sechilienne (FR)" and insert -- Milena Stefanova, Saint Barthelemy De Sechiliene (FR) --, delete "Jacques Fagot, Saint Jean de Moirans (FR) and insert -- Jacques Fagot, Saint Jean De Moirans (FR) --

Signed and Sealed this

Fifth Day of April, 2005

JON W. DUDAS
*Director of the United States Patent and Trademark Office*